US010544494B2

(12) United States Patent
Sawa et al.

(10) Patent No.: US 10,544,494 B2
(45) Date of Patent: Jan. 28, 2020

(54) HIGH-STRENGTH 6000-BASED ALLOY THICK PLATE HAVING UNIFORM STRENGTH IN PLATE THICKNESS DIRECTION AND METHOD FOR MANUFACTURING THE SAME

(71) Applicant: UACJ CORPORATION, Chiyoda-ku, Tokyo (JP)

(72) Inventors: Yuya Sawa, Tokyo (JP); Minoru Hayashi, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 326 days.

(21) Appl. No.: 15/602,839

(22) Filed: May 23, 2017

(65) Prior Publication Data

US 2017/0356073 A1 Dec. 14, 2017

(30) Foreign Application Priority Data

Jun. 13, 2016 (JP) ..... 2016-116799

(51) Int. Cl.

| | |
|---|---|
| ***C22F 1/05*** | (2006.01) |
| ***C22C 21/08*** | (2006.01) |
| ***C22F 1/057*** | (2006.01) |
| ***C22C 21/14*** | (2006.01) |
| ***C22C 21/16*** | (2006.01) |
| ***C22F 1/047*** | (2006.01) |
| *C22F 1/04* | (2006.01) |
| *C22C 21/00* | (2006.01) |
| *C22C 21/02* | (2006.01) |

(52) U.S. Cl.

CPC ..... *C22F 1/057* (2013.01); *C22C 21/08* (2013.01); *C22C 21/14* (2013.01); *C22C 21/16* (2013.01); *C22F 1/047* (2013.01)

(58) Field of Classification Search

CPC ..... C22F 1/04–057

See application file for complete search history.

(56) References Cited

FOREIGN PATENT DOCUMENTS

| | | | | |
|---|---|---|---|---|
| JP | 4174526 B2 | | 11/2008 | |
| JP | 2011-231359 A | | 11/2011 | |
| JP | 2011231359 | * | 11/2011 | ..... C22C 21/02 |
| JP | 2013-517383 A | | 5/2013 | |

* cited by examiner

*Primary Examiner* — Lois L Zheng

(74) *Attorney, Agent, or Firm* — Orrick, Herrington & Sutcliffe LLP; Joseph A. Calvaruso; K. Patrick Herman

(57) ABSTRACT

The present invention relates to a high-strength aluminum alloy thick plate composed of an aluminum alloy including a prescribed quantity of Si, Mg, Ti, Fe, and the balance Al. The thick plate has a material structure in which an area ratio of $Mg_2Si$ having circle equivalent diameters of 3 μm or more in a plate thickness central portion is 0.45% or less; and an area ratio of $Mg_2Si$ having circle equivalent diameters of 3 μm or more in a region of 20 mm±1.5 mm from a plate surface in a plate thickness direction is 1.2 times or more and 3.0 times or less the area ratio of $Mg_2Si$ having circle equivalent diameters of 3 μm or more in the plate thickness central portion. The aluminum alloy thick plate has sufficient strength and good uniformity of strength in the plate thickness direction, and can be manufactured by cooling it after a solution treatment, so that suitable temperature difference occurs between a plate thickness central portion and a surface, and then performing a quenching treatment.

4 Claims, No Drawings

HIGH-STRENGTH 6000-BASED ALLOY THICK PLATE HAVING UNIFORM STRENGTH IN PLATE THICKNESS DIRECTION AND METHOD FOR MANUFACTURING THE SAME

BACKGROUND OF THE INVENTION

1. Field of the Invention

The present invention relates to a high-strength aluminum alloy thick plate and a method for manufacturing the same. Concretely, it relates to a high-strength aluminum alloy thick plate for use in manufacturing apparatuses of an electronic component such as a liquid crystal panel or semiconductor manufacturing apparatuses, or machine components such as a vacuum chamber, and to a method for manufacturing the same.

2. Description of Related Art

JIS 6000-based alloys (Al—Mg—Si-based alloys) including AA 6061 alloy are known as an age hardening type aluminum alloys, and are aluminum alloys whose strength is improved by natural aging after a solution treatment and subsequent quenching. Further, the aluminum alloy increases strength by being further subjected to artificial aging, and therefore, is used broadly for vehicles and ships as an extrusion-molded material or a plate material, or as a structural member.

Until now, in a method for manufacturing a thick plate composed of a high-strength aluminum alloy such as AA 6061 alloy, an artificial aging treatment may be performed as necessary after subjecting an ingot to hot rolling and, after that, to a solution treatment and quenching. In the manufacturing method, material deformation is generated in a thick plate by heating/cooling, and, therefore, stretch is performed after a solution treatment and quenching for a purpose of removing residual stress and flat correction. The flat correction is necessary, in particular, when a thick plate is to be manufactured via hot rolling. However, in general, in stretch correction after a solution treatment, when a size including plate thickness (cross-section area) is large, a load in the correction is large and large facilities are required. For example, for a thick plate having t exceeding 200 mm, correction has been very difficult for one having been subjected to the above-described manufacturing process, from a limit of stretch facilities.

However, in recent years, materials having a more thicker plate thickness are requested. The request is, for example, based on requirement for increase in size of a manufacturing apparatus of an electronic component such as a liquid crystal panel, a semiconductor manufacturing apparatus or a machine component such as a vacuum chamber. In order to meet the needs for increase in plate thickness of a high-strength aluminum alloy thick plate, various studies have been conducted on the manufacturing method thereof.

Examples of reports of technologies coping with the requirement for thick plate materials include, for example, PTL 1 in which there is proposed a method for manufacturing a thick plate by slicing an ingot having been subjected to a heat treatment for a purpose of removing internal stress or improving microsegregation, without subjecting an Al—Mg—Si-based alloy ingot to hot rolling.

Further, in PTL 2, there is proposed a method for manufacturing a high-strength thick plate by heating an Al—Mg—Si-based alloy ingot to a temperature of 480° C. or higher for 1 hour or longer to perform a solution treatment, then performing a quenching treatment with a cooling rate of 100° C./hr or larger at the central portion of the ingot, and subsequently performing an artificial aging treatment at a temperature of 150 to 250° C. for 1 hour or longer. Moreover, in PTL 3, there is proposed a method for obtaining a high-strength thick plate by subjecting an Al—Mg—Si-based alloy ingot to a solution treatment at a temperature of 450 to 560° C., and cooling the same at a cooling rate of 200° C./hr between the solution temperature and 200° C. to perform arbitrary tempering.

CITATION LIST

Patent Literature

PTL 1: Japanese Patent No. 4174526

PTL 2: Japanese Patent Laid-Open Publication No. 2011-231359

PTL 3: Published Japanese translation of PCT patent application No. 2013-517383

SUMMARY OF THE INVENTION

Technical Problem

Methods described in the above-described respective Patent Literatures can manufacture ultrathick plate having a thickness exceeding 200 mm in a method for manufacturing an aluminum alloy thick plate. However, according to the present inventors, it is confirmed that these aluminum alloy thick plates manufactured in accordance with the conventional technologies have problems in material strength and unevenness of strength in a plate thickness direction.

That is, in the method in PTL 1, a heat treatment for removing internal stress or for removing microsegregation is performed. However, a solution treatment and a quenching treatment are characteristic treatments for heat treatment-based alloys such as a high-strength 6000-based aluminum alloy in order to improve strength. In the method described in PTL 1, there is such a problem that a solution treatment is not performed, and sufficient strength cannot be obtained in materials having a thick plate thickness.

Further, in the methods in PTL 2 and PTL 3, a solution treatment and a subsequent quenching are performed, and therefore, a high-strength thick plate can be obtained. However, when the plate thickness increases, difference in cooling rates arises in a plate thickness direction upon quenching, and therefore, states of quenching differ in a plate thickness direction and the strength does not become uniform. If the strength in a plate thickness direction becomes not uniform and a site at which strength changes suddenly exists in a material, stress concentrates on a part of low strength, which may cause a problem such as degradation in fatigue properties. The problem cannot be ignored in consideration of requirement for increasing plate thickness for high-strength aluminum alloy thick plates in these years.

The present invention was achieved against the background as described above, and provides a high-strength 6000-based aluminum alloy thick plate, which has good uniformity of strength in a plate thickness direction with sufficient strength. Further, it provides a method capable of manufacturing a high-strength aluminum alloy thick plate while meeting the requirement for increase in plate thickness, as a method for manufacturing a high-strength aluminum alloy thick plate.

Solution to Problem

As described above, it is possible to say that a solution treatment and quenching are important treatments for heat treatment-based alloys such as a high-strength 6000-based aluminum alloy in order to improve strength of the alloy. Accordingly, in order to solve the above-described problem, the present inventors examined reducing the difference in strengths between, by controlling deposition states of deposits in, both a plate surface portion on which the effect of rapid cooling in quenching acted most remarkably and an inner part of the plate on which the effect of rapid cooling was hard to act. Nevertheless, it is not necessarily easy to control the deposition state of deposits in a plate thickness direction. This is because it would be difficult to suppress strength and weakness of the effect of rapid cooling in a thickness direction, that is, difference in cooling rates, when an aluminum alloy thick plate is subjected to a solution treatment and quenching.

Consequently, as the result of examinations, the present inventors found such a technique of lowering a temperature in a plate thickness surface layer portion than that in an inner part of the plate prior to quenching, to deposit deposits sparsely while making the deposits coarse in the plate thickness surface layer portion. Further, the present inventors conceived that performing the deposition treatment decreases a number density of minute deposits formed in the plate thickness surface layer portion in an aging treatment of a post-process of quenching, and as the result, can lower the difference in strengths between a plate thickness surface layer portion and a plate thickness central portion.

Here, when the temperature in the plate thickness surface layer portion is made lower than that in the inner part of the plate prior to quenching for the deposition treatment as described above, a temperature gradient is generated in a plate thickness direction, and, therefore, a deposition quantity of coarse deposits is made gradually small from the plate thickness surface layer portion toward the plate thickness central portion. The relationship of the deposition quantities of coarse deposits between the plate thickness surface layer portion and the inner part of the plate is maintained even via quenching after the deposition treatment and aging treatment. The present inventors performed additional examinations and found a method for manufacturing a thick plate including suitable conditions of the deposition treatment and a constitution of a thick plate material having a suitable deposition state of deposits, to conceive the present invention.

That is, the present invention is a high-strength aluminum alloy thick plate composed of an aluminum alloy including Si: 0.2 to 1.2 mass % (hereinafter, denoted by %), Mg: 0.2 to 1.5%, Ti: 0.005 to 0.15%, Fe: 1.0% or less, a balance Al and inevitable impurities, the high-strength aluminum alloy thick plate having a material structure in which an area ratio of $Mg_2Si$ having circle equivalent diameters of 3 μm or more in a plate thickness central portion is 0.45% or less; and an area ratio of $Mg_2Si$ having circle equivalent diameters of 3 μm or more in a region of 20 mm±1.5 mm from a plate surface in a plate thickness direction is 1.2 times or more and 3.0 times or less the area ratio of $Mg_2Si$ having circle equivalent diameters of 3 μm or more in the plate thickness central portion.

Further, the aluminum alloy constituting the high-strength aluminum alloy thick plate can further contain any one or more of Cu: 0.05 to 1.2%, Zn: 0.05 to 0.5%, Mn: 0.05 to 1.0%, Cr: 0.05 to 0.5%, and Zr: 0.05 to 0.2%.

Further, the present inventive method for manufacturing a high-strength aluminum alloy thick plate including the steps of: performing a solution treatment of heating an aluminum alloy of the above-described composition at a temperature of 480° C. or higher for an hour or longer; after the solution treatment step, cooling the aluminum alloy so that temperature in a plate thickness central portion becomes 480° C. or higher and temperature in a surface becomes lower than the temperature in the plate thickness central portion by 10° C. or more and 30° C. or less; after the cooling step, performing a quenching treatment of quenching the aluminum alloy so that a cooling rate of the plate thickness central portion of the aluminum alloy becomes 100° C./hr or larger; and, further performing an artificial aging treatment.

Meanwhile, in the manufacturing method, a treatment for flattening the surface of the aluminum alloy may be performed prior to the solution treatment and quenching treatment.

Advantageous Effects of Invention

The present inventive high-strength aluminum alloy thick plate has high strength, and has more uniform strength in the plate thickness direction. Further, the present inventive method for manufacturing a high-strength aluminum alloy thick plate can manufacture effectively a high-strength alloy thick plate while making strengths in the plate thickness direction uniform. In conventional methods for manufacturing an alloy thick plate, when a hot rolling process is included, a flat correction for reducing internal stress has been necessary. Consequently, manufacture of thick plates of 200 mm or thicker has been difficult due to restriction on flat correction facilities. The present invention does not require a hot rolling process as an inevitable process, and therefore, does not require flat correction, and can respond to the manufacture of thick plates of 200 mm or thicker. Accordingly, the present invention exerts a particularly large effect when thick plates of 200 mm or thicker are to be manufactured.

BEST MODES FOR CARRYING OUT THE INVENTION

The present inventive high-strength aluminum alloy thick plate and the method for manufacturing the same will be described in more detail below. First, constituent elements and material structure of the aluminum alloy in the present invention will be described. As described above, the present inventive high-strength aluminum alloy thick plate contains Si, Mg, Ti, and Fe. Meanwhile, in the specification of the present application, a simple expression of "%" in the description of a component composition of an alloy means "mass %."

Si: 0.2 to 1.2%

Si is solid-dissolved into a matrix by a solution treatment to contribute to strength improvement. Moreover, when Si coexists with Mg, minute $Mg_2Si$ deposits are formed by natural aging, which is deposited as $Mg_2Si$ by artificial aging to contribute to the improvement of strength. The effect is insufficient when the content is less than 0.2%, and is saturated when it exceeds 1.2%. Accordingly, the content of Si is desirably 0.2 to 1.2%, more preferably 0.4 to 0.8%.

Mg: 0.2 to 1.5%

Mg is solid-deposited into a matrix and contributes to strength improvement in the same way as Si, and, furthermore, when Mg coexists with Si, minute $Mg_2Si$ deposits are formed by natural aging and $Mg_2Si$ is deposited by artificial aging to contribute to the improvement of strength. The effect is insufficient when the content is less than 0.2%, and is saturated when it exceeds 1.5%. Accordingly, the content of Mg is desirably 0.2 to 1.5%, more preferably 0.8 to 1.2%.

Ti: 0.005 to 0.15%

Ti acts on fining of crystal grains in casting. The effect is insufficient when the content is less than 0.005%, and, when it exceeds 0.15%, the effect is saturated and coarse compounds are formed easily. Accordingly, the content of Ti is desirably 0.15% or less.

Fe: 1.0% or Less

Fe is an element contained as an impurity. Fe forms an Al—Fe-based compound to deteriorate the elongation and toughness of the alloy. Therefore, the content of Fe is desirably as little as possible. Industrially, it may be 1.0% or less.

Further, the present inventive high-strength aluminum alloy thick plate can further contain any one or more of Cu, Zn, Mn, Cr and Zr, in addition to Si, Mg and Ti.

Cu: 0.05 to 1.2%

Cu is solid-dissolved into a matrix and has a role to enhance strength. The effect is insufficient when the content is less than 0.05%, and corrosion resistance deteriorates when it exceeds 1.2%. Accordingly, the content of Cu is desirably 0.05 to 1.2%. When particularly high strength is needed, it is particularly desirable to be 0.2% to 1.2%.

Zn: 0.05 to 0.5%

Zn is solid-dissolved into a matrix and has a function of enhancing strength. The effect is insufficient when the content is less than 0.05%, and is saturated when it exceeds 0.5% and the corrosion resistance deteriorates. Accordingly, the content of Zn is desirably 0.05 to 0.5%.

Mn: 0.05 to 1.0%

Mn is solid-dissolved into a matrix or disperses fine deposits and has a role to enhance strength. The effect is insufficient when the content is less than 0.05%, and, when it exceeds 1.0%, the effect is saturated and coarse compounds are formed easily. Accordingly, the content of Mn is desirably 0.05 to 1.0%.

Cr: 0.05 to 0.5%

Cr has a role to disperse fine deposits in a matrix to enhance strength. The effect is insufficient when the content is less than 0.05%, and, when it exceeds 0.5%, the effect is saturated and huge crystallized products are formed easily. Accordingly, the content of Cr is desirably 0.05 to 0.5%.

Zr: 0.05 to 0.2%

Zr has a role to disperse fine deposits in a matrix to enhance strength. The effect is saturated and huge crystallized products are formed easily. Accordingly, the content of Zr is desirably 0.05 to 0.2%.

Constituent elements other than the above-described component elements that constitute the alloy in the present invention are Al and inevitable impurities. The inevitable impurities are allowed in a range that does not affect the present invention. Desirably, contents of respective elements contained as inevitable impurities are 0.05% or less and are 0.15% or less in total.

Next, the material structure of the present inventive aluminum alloy will be described.

The aluminum alloy of the present invention is so constituted that the alloy has uniform strength in a plate thickness direction by controlling the size of $Mg_2Si$ being a deposit and distribution of the deposits in a plate thickness direction. The size of $Mg_2Si$ in the structure of a plate material is various, and the present inventors paid attention, particularly, to $Mg_2Si$ having circle equivalent diameters of 3 μm or more, and found that it is possible to reduce variation of strength in the thickness direction of a plate material by controlling an area ratio thereof.

As conditions for the area ratio of $Mg_2Si$ having circle equivalent diameters of 3 μm or more, it is first and foremost necessary that the area ratio of $Mg_2Si$ having circle equivalent diameters of 3 μm or more in a plate thickness central portion is 0.45% or less. This is a condition for securing strength of the plate thickness central portion. That is, when an area ratio of $Mg_2Si$ having circle equivalent diameters of 3 μm or more in the plate thickness central portion exceeds 0.45%, strength of the plate thickness central portion decreases, and a plate material with sufficient strength cannot be obtained. Meanwhile, it is important to reduce $Mg_2Si$ having circle equivalent diameters of 3 μm or more as much as possible. Accordingly, the present invention has no problem even if the lower limit of the $Mg_2Si$ area ratio is 0%. Further, the plate thickness central portion means, as described, the central portion of a thick plate material in the plate thickness direction.

Further, the present invention requires that a deposition quantity of coarse deposits in the plate thickness surface layer portion is larger than a deposition quantity thereof in the plate central portion. Concretely, in a region of 20 mm±1.5 mm from the plate surface in the plate thickness direction, an area ratio of $Mg_2Si$ having circle equivalent diameters of 3 μm or more is set to be 1.2 times or more and 3.0 times or less that in the plate thickness central portion.

That the area ratio of coarse deposits in the plate thickness surface layer portion is large as described above is caused by a deposition treatment of deposits in the manufacturing process of the plate material, and, hereby, the uniformity of strength in the plate thickness direction is secured. That is, in the present invention, coarse deposits are made to be deposited prior to quenching in the plate thickness surface layer portion on which the effect of rapid cooling becomes largest in quenching, to make the area ratio thereof high. Hereby, it becomes possible to decrease a number density of deposits (fine $Mg_2Si$) in the region that will be deposited in a subsequent aging treatment. On the other hand, the plate thickness central portion has been cooled rapidly from a high temperature that is equal to or higher than the temperature at which coarse deposits are deposited, and, therefore, deposition of coarse deposits are suppressed. In the plate thickness central portion, although the effect of rapid cooling in quenching is small, the deposition density of coarse deposits is low ($Mg_2Si$ area ratio of 0.45% or less) and, therefore the strength increases by deposits in an aging treatment, and difference in the strength from that of the plate thickness surface layer portion can be reduced.

Furthermore, the present inventive aluminum alloy requires that the area ratio of $Mg_2Si$ having circle equivalent diameters of 3 μm or more is 1.2 times or more and 3.0 times or less that in the plate thickness central portion, in a region of 20 mm±1.5 mm from the plate surface in the plate thickness direction. The reason is that, when the area ratio in the plate thickness surface layer portion is less than 1.2 times the area ratio in the plate thickness central portion, deposits are deposited finely with high density in the plate thickness surface layer portion in an aging treatment, and strength in the plate thickness surface layer portion becomes high to increase a difference in the strength from that of the plate thickness central portion. On the other hand, as for 3.0 times being the upper limit, the efficiency in manufacturing thick plates is considered. As will be described later, a deposition treatment in the plate thickness surface layer portion performed prior to quenching is a treatment for forming a temperature difference between the plate surface portion and the plate thickness central portion, but there is a limit in a formable temperature difference in an aluminum alloy having high thermal conductivity, and it is difficult to manufacture one having an area ratio of the plate thickness surface layer portion exceeding three times an area ratio in the plate thickness central portion.

Next, the present inventive method for manufacturing a high-strength aluminum alloy thick plate will be described. As described above, the present inventive method for manufacturing a high-strength aluminum alloy thick plate includes performing a solution treatment on an ingot of an aluminum alloy, then performing a treatment of cooling the aluminum alloy while controlling the temperature of a plate thickness surface to deposit coarse deposits in the plate thickness surface layer portion, subsequently performing a quenching treatment, and further performing an artificial aging treatment. Hereinafter, detailed description will be given.

First, an aluminum alloy having the above-described component composition is smelted according to an ordinary method. An aluminum alloy is cast by suitably selecting a usual casting method such as a continuous casting method or a semi-continuous casting method (DC casting method).

Then, a homogenizing treatment can be performed as necessary on an obtained aluminum alloy. When a homogenizing treatment is to be performed, the treatment conditions are not particularly limited, and preferably, heating is performed at a temperature of 480 to 590° C. for 0.5 to 24 hours, more preferably at a temperature of 500 to 560° C. for 1 to 20 hours. When a homogenizing treatment temperature is lower than 480° C. or a treating time is shorter than 0.5 hours, the effect of homogenization may not be obtained sufficiently. On the other hand, when a homogenizing treatment temperature exceeds 590° C., there is the risk that the material melts. Further, when a treating time exceeds 24 hours, the productivity lowers.

Hot rolling can be performed on an aluminum alloy having been subjected to a homogenizing treatment as necessary. When hot rolling is to be performed, in a process from completion of the homogenizing treatment to start of hot rolling, any of following treatment methods can be applied as necessary. That is, subsequent to cooling to ordinary temperature or near to ordinary temperature in a cooling process after the homogenizing treatment, it is possible to perform anew heating to start temperature of hot rolling and start hot rolling. Further, it is also possible to perform cooling to start temperature of hot rolling in a cooling process after a homogenizing treatment, and to start directly hot rolling. Then, hot rolling can be performed under conventional general conditions, and the temperature may be controlled to a temperature allowing hot rolling, for example, with hot rolling starting temperature set to be 250° C. or higher and lower than 580° C. and hot rolling end temperature set to be 150° C. or higher.

A solution treatment is performed on an aluminum alloy cast in this way, or an aluminum alloy material having been subjected to a homogenizing treatment or hot rolling as necessary. The present inventive aluminum alloy is a heat treatment-based alloy, and an intended strength is obtained by causing a crystallized product such as $Mg_2Si$ generated in casting to be solid-dissolved into a matrix. This treatment is called a solution treatment. Temperature in the solution treatment shall be 480° C. or higher. When the temperature is lower than 480° C., above-described effects cannot be obtained sufficiently. The upper limit temperature in the solution treatment is not particularly prescribed, but, when it exceeds a melting point, there is the risk that internal defects such as porosity occur, and therefore, it shall be lower than a melting point, particularly preferably 560° C. or lower.

Treatment time in the solution treatment is preferably set to be 1 hour or longer. When it is shorter than 1 hour, diffusion of elements is insufficient and a uniform solid-solution state cannot be obtained. Further, the upper limit of the treating time is not particularly defined, but, industrially, an economical and sufficient effect can be obtained by setting it to be 48 hours or shorter, more preferably 24 hours or shorter.

In a general method for manufacturing an aluminum alloy plate material, a quenching treatment is performed immediately after the solution treatment. However, in the present invention, performed is a treatment of cooling an aluminum alloy held at high temperatures in the solution treatment prior to quenching to deposit deposits of coarse $Mg_2Si$ in the plate thickness surface layer portion. In the deposition treatment, the cooling is performed so that a temperature of the plate thickness central portion of an ingot becomes 480° C. or higher and a temperature at the surface of the ingot becomes lower than the temperature of the plate thickness central portion in a range of 10° C. or more and 30° C. or less.

In the deposition treatment, when the surface temperature of an aluminum alloy plate is higher than "the temperature of the plate thickness central portion—10° C.," it is in a state where Mg and Si are solid-dissolved in a matrix in large quantities, and coarse deposits have not been deposited sufficiently. If an artificial aging treatment is performed while maintaining this state, solid-dissolved Mg and Si are deposited as fine $Mg_2Si$, and therefore, an increase in the strength of the plate thickness surface layer portion becomes large and difference in strength between the plate thickness central portion and the plate thickness surface layer portion becomes large. Consequently, it is necessary to set surface temperature of an aluminum alloy to be lower than the temperature of the plate thickness central portion by 10° C. or more. However, aluminum has high thermal conductivity and, therefore, it is difficult to hold a surface temperature of a plate to be lower than the temperature of the plate thickness central portion by 30° C. or more.

Further, in the deposition treatment, the temperature of the plate thickness central portion is set to be 480° C. or higher. When it becomes 480° C. or lower, coarse $Mg_2Si$ deposits are deposited sparsely in the plate thickness central portion, and, even after a subsequent artificial aging treatment, sufficient strength cannot be obtained in the plate thickness central portion. As the result, difference in strength between the plate thickness central portion and the plate thickness surface layer portion becomes large.

The above cooling method for a deposition treatment of an aluminum alloy is not particularly restricted, and treatments, in which temperature difference between the surface temperature of an aluminum alloy and the temperature of the plate thickness central portion becomes 10° C. or more and 30° C. or less, are acceptable. If it is a suitable temperature difference, for example, a method of contacting a cooling medium to the vicinity of the surface of an aluminum alloy is acceptable. However, as a suitable and simple method from an industrial viewpoint, there is mentioned a method of exposing an aluminum alloy having been subjected to a solution treatment to an atmosphere for performing a quenching treatment to cool it, and performing a quenching treatment when the temperature difference between a surface temperature and a temperature of the plate thickness central portion becomes 10° C. or more and 30° C. or less.

A quenching treatment is performed on the aluminum alloy having been subjected to the above deposition treatment. Quenching is a treatment of leaving an aluminum alloy in the state where elements solid-dissolved into a matrix in the solution treatment remain being solid-dissolved, without depositing elements solid-dissolved in a matrix by rapid cooling the aluminum alloy. In the quenching treatment, cooling is performed at a cooling rate of 100° C./hr or larger. When the cooling rate is smaller than 100° C./hr, quenching becomes insufficient, and sufficient strength cannot be obtained in an artificial aging treatment. Accordingly, the cooling rate in a solution treatment is desirably 100° C./hr or larger. As the cooling rate, preferably a cooling rate in the central portion in a plate thickness direction of an aluminum alloy is applied.

Meanwhile, when quenching is performed directly from a solution treatment temperature without performing a deposition treatment, a deposition quantity of coarse deposits decreases in the plate thickness surface layer portion on which the effect of rapid cooling is high. Further, in the plate thickness surface layer portion, fine deposits are deposited densely in a subsequent artificial aging treatment. In the situation, the area ratio of $Mg_2Si$ having circle equivalent diameters of 3 μm or more in the region of 20 mm±1.5 mm in a plate thickness direction, which is required in the present invention, becomes small, and the area ratio becomes less than 1.2 times an area ratio of $Mg_2Si$ in the plate thickness central portion having a small cooling rate. Such a plate material has a large difference in strength between the plate thickness surface layer portion and the plate thickness central portion, and is not applicable to the aluminum alloy thick plate of the present invention capable of solving the problem.

In the present inventive aluminum alloy, the strength can be enhanced by performing a solution treatment, quenching and, furthermore, an artificial aging treatment to deposit fine $Mg_2Si$. Temperature in the artificial aging treatment is preferably 150 to 250° C. When it is lower than 150° C., a long time aging treatment is necessary until sufficient strength is obtained, which is uneconomical. On the other hand, when it exceeds 250° C., coarse $Mg_2Si$ is deposited easily, which may lower the strength.

Further, as for the time of an artificial aging treatment, holding time is preferably 1 to 24 hours. Setting of aging time has a strong relationship with an aging temperature, and, when aging treatment time is shorter than 1 hour, sufficient strength cannot be obtained, or variation of strength becomes large. The upper limit is not particularly defined, but is preferably 24 hours or shorter from the economical viewpoint. As for conditions of an artificial aging treatment, a treatment is more preferably performed at 170 to 190° C. for 6 to 12 hours. Under the conditions, the manufacturing is industrially and stably possible.

Meanwhile, in the present inventive method for manufacturing an aluminum alloy thick plate, it is possible to perform suitably a flattening treatment of an ingot surface of an aluminum alloy. Examples of performable flattening treatments include, for example, mechanical processing such as facing and polishing, chemical polishing, etc. A flattening treatment can be performed prior to a solution treatment and a quenching treatment.

The present inventive aluminum alloy material manufactured via the above processes may exert strength of 200 MPa or more, and yield strength of 140 MPa or more in the plate thickness surface layer portion and plate thickness central portion. Moreover, difference in strength between the plate thickness surface layer portion and the plate thickness central portion is reduced to be 5.0 MPa or less. Meanwhile, the present inventive aluminum alloy material can give strength of 200 MPa or more and yield strength of 140 MPa or more that exceed largely those of H112 material of the JIS 5052 alloy, which is not a heat treatment-based alloy, and the application of the same to more broad fields is expected.

Thickness of the present inventive aluminum alloy thick plate is not particularly limited. Aluminum alloy thick plates having arbitrary thicknesses can be obtained as long as the material structure or the manufacturing condition having been described heretofore is satisfied. However, in instances of thick plates having thicknesses exceeding 650 mm, an aluminum thick plate itself works as a heat source to make it difficult to obtain a sufficient cooling rate. Further, the present invention is particularly effective for an application to a plate having thickness of 200 mm or more, manufacturing of which is considered to be difficult from circumstances such as restriction on flattening correction described above. Accordingly, as for an application range of the present invention, aluminum alloy thick plates of 200 mm or more and 650 mm or less are preferable.

EXAMPLES

First Embodiment

Hereinafter, concrete embodiments of the present invention will be described with Comparative Examples. In the present embodiment, aluminum alloy thick plates of various compositions were manufactured and measurement of strength and observation of a material structure were performed.

[Manufacturing of Aluminum Alloy Thick Plate]

Aluminum alloy ingots of compositions shown in Table 1 (T 320 mm×W 1500 mm×L 3500 mm) were produced on an industrial scale, which were cut to give an aluminum alloy material (T 320 mm×W 1400 mm×L 3000 mm). Meanwhile, T shows plate thickness, W shows plate width, and L shows plate length.

TABLE 1

Unit: mass %

| Alloy No. | | Si | Mg | Fe | Ti | Cu | Zn | Mn | Cr | Zr | Al |
|---|---|---|---|---|---|---|---|---|---|---|---|
| Example | A | 0.61 | 0.91 | 0.4 | 0.06 | 0.2 | 0.5 | 0.05 | — | — | Balance |
| | B | 0.48 | 1.18 | 0.44 | 0.15 | — | 0.2 | — | — | — | Balance |
| | C | 0.55 | 1.49 | 0.15 | 0.006 | 0.81 | — | 0.5 | 0.5 | — | Balance |
| | D | 0.75 | 1.02 | 0.35 | 0.1 | 0.06 | — | — | — | — | Balance |
| | E | 0.22 | 0.85 | 0.81 | 0.12 | 1.2 | — | — | — | 0.2 | Balance |
| | F | 0.88 | 0.21 | 0.25 | 0.13 | — | — | 0.9 | 0.04 | — | Balance |
| | G | 0.45 | 0.65 | 0.7 | 0.05 | — | 0.05 | — | 0.1 | 0.05 | Balance |
| | H | 1.1 | 1.25 | 0.35 | 0.1 | 0.04 | — | — | — | 0.12 | Balance |
| Comparative example | I | 0.66 | 1.8 | 1.1 | 0.06 | — | — | 0.74 | — | — | Balance |
| | J | 0.11 | 0.63 | 0.35 | 0.001 | 0.2 | 0.5 | 0.03 | — | — | Balance |
| | K | 1.6 | 1.3 | 0.6 | 0.16 | 0.3 | 0.1 | 0.81 | — | — | Balance |
| | L | 0.34 | 0.17 | 0.4 | 0.06 | 0.2 | 0.5 | 0.05 | — | — | Balance |

Facing of 10 mm for a side was performed on the obtained aluminum alloy material as a surface flattening treatment, and then a solution treatment was performed. As for conditions of the solution treatment, high temperature retention at 530° C.×10 hours was performed.

Then, the aluminum alloy material after the solution treatment was cooled to a predetermined temperature in the air whose atmospheric temperature was controlled prior to quenching to perform a deposition treatment for depositing coarse deposits in a plate thickness surface layer portion. In the deposition treatment, a thermocouple was attached to the plate thickness central portion of the aluminum alloy surface to survey the temperature, and it was confirmed that the temperature of the plate thickness central portion became 480° C. or higher and the temperature of the aluminum alloy surface was lower than the temperature of the plate thickness central portion by 10° C. or more. Temperatures of the surface and the central portion of an aluminum alloy before quenching treatment are listed in Table 2.

A quenching treatment was performed by cooling the aluminum alloy material with water. At this time, a thermocouple was attached to the plate thickness central portion to survey a cooling rate, and an average cooling rate between material temperatures of 450° C. to 250° C. was measured. Measured cooling rates are listed in Table 2.

Then, an artificial aging treatment was performed on the aluminum alloy material after the quenching treatment. The artificial aging treatment was performed under conditions of 180° C.×10 hours.

[Structure Observation of Aluminum Alloy Thick Plate]

Material structures of the aluminum alloy thick plates manufactured in the present embodiment were observed to measure the area ratio of $Mg_2Si$ having circle equivalent diameters of 3 μm or more. For the observation of a material structure, a scanning electron microscope (SEM) was used. In the structure observation, for a region located at 300 mm from the edge portion in a length direction of the alloy plate material and at the central portion in a width direction, cross-section structures of the surface layer portion (a region of 20 mm±1.5 mm from the plate surface in the plate thickness direction) and the plate thickness central portion were observed and imaged. At this time, an image of $3.7\times10^5$ $\mu m^2$ was photographed at a magnification of 250 times to measure an area ratio of $Mg_2Si$ in the range. In the measurement of the area ratio, the area ratio was obtained by use of a particulate analysis capability of a commercially available image analysis software (trade name "A zo-kun" manufactured by Asahi Kasei Engineering Corporation) for the obtained image (one visual field).

[Strength Measurement of Aluminum Alloy Thick Plate]

Next, strength measurements of the surface layer portion and plate thickness central portion were performed on the aluminum alloy thick plate manufactured in the present embodiment. Here, JIS No. 4 test pieces (ϕ 14 mm) were gathered at a position of 20 mm from the surface of the obtained aluminum alloy thick plate in the plate thickness direction, and from the plate thickness central portion, and a tensile test (in plate width direction) was performed. The tensile test was performed on two pieces respectively based on JIS Z 2241 standard, and the average value was used as an evaluation object. In the present embodiment, as a criterion for deciding a passing status regarding the strength of the manufactured aluminum alloy thick plate, the minimum values of tensile strength (TS) and yield strength (YS) of the plate thickness central portion were evaluated. Furthermore, difference between tensile strengths (TS) of the plate thickness surface layer portion and the plate thickness central portion was calculated to evaluate a passing status of presence or absence of the strength difference in the plate thickness direction. Meanwhile, as a criterion of deciding the passing status of strength of a thick plate, there were adopted tensile strength of 200 MPa or more and yield strength of 140 MPa or more, which were prescribed in JIS standard for H112 material of JIS 5052 alloy, which was not a heat treatment-based alloy having been actually used for a vacuum chamber material etc., and those higher than this was decided to be "success" and those lower than this was decided to be "failure." On the other hand, as for the presence or absence of the strength difference in the plate thickness direction, those in which the difference in strengths between the plate thickness surface layer portion and the plate thickness central portion was 50 MPa or less were decided as "success."

[Measurement of Warpage Quantity of Aluminum Alloy Thick Plate]

For the obtained aluminum alloy thick plate (T 300 mm×W 1400 mm×L 3000 mm), there was measured magnitude of warpage generated when the plate was cut from the surface to the plate thickness central portion in the plate thickness direction. In the measurement of a warpage quantity, a cut plate was placed on a surface plate and magnitude of a gap generated by a curve of the plate was measured. A larger warpage quantity generated at this time means that a warpage quantity is larger when cutting processing is performed, and it was decided as "success" when the warpage quantity per 1000 mm of width was 3 mm or less and as "failure" when it exceeded 3 mm.

There are listed, in Table 2, results of area ratio measurement of deposits and evaluation of mechanical properties performed for respective aluminum alloy thick plates manufactured in the present embodiment.

TABLE 2

| | | | Ingot temperature before quenching | | | | Area ratio of $Mg_2Si$ (%) | | | Tensile properties of plate thickness central portion | | | | |
|---|---|---|---|---|---|---|---|---|---|---|---|---|---|---|
| Manufacturing No. | | Alloy No. | Surface | Central portion | Central portion – Surface | Cooling rate (° C./hr)*1 | Surface layer portion | Central portion | Surface layer/ Central portion | TS (Mpa) | YS (Mpa) | EL (%) | Difference in strength (Mpa) | Evaluation of warpage |
| Example | 1 | A | 478° C. | 503° C. | 25° C. | 368 | 0.71 | 0.29 | 2.45 | 226 | 172 | 8.9 | 40 | ○ |
| | 2 | B | 476° C. | 500° C. | 24° C. | 370 | 0.65 | 0.23 | 2.83 | 219 | 168 | 9.1 | 37 | ○ |
| | 3 | C | 476° C. | 500° C. | 24° C. | 372 | 0.79 | 0.33 | 2.39 | 240 | 187 | 8.2 | 36 | ○ |
| | 4 | D | 480° C. | 502° C. | 22° C. | 371 | 0.74 | 0.31 | 2.39 | 221 | 170 | 8.6 | 41 | ○ |
| | 5 | E | 481° C. | 506° C. | 25° C. | 365 | 0.81 | 0.44 | 1.84 | 222 | 169 | 9.4 | 34 | ○ |
| | 6 | F | 485° C. | 503° C. | 18° C. | 375 | 0.74 | 0.43 | 1.72 | 209 | 146 | 11 | 29 | ○ |
| | 7 | G | 476° C. | 500° C. | 24° C. | 371 | 0.67 | 0.33 | 2.03 | 213 | 157 | 10.1 | 32 | ○ |
| | 8 | H | 472° C. | 500° C. | 28° C. | 368 | 0.62 | 0.30 | 2.07 | 232 | 178 | 7.9 | 47 | ○ |

TABLE 2-continued

| Manufacturing No. | Alloy No. | Ingot temperature before quenching: Surface | Central portion | Central portion – Surface | Cooling rate (° C./hr)*1 | Area ratio of $Mg_2Si$ (%): Surface layer portion | Central portion | Surface layer/ Central portion | Tensile properties of plate thickness central portion: TS (Mpa) | YS (Mpa) | EL (%) | Difference in strength (Mpa) | Evaluation of warpage |
|---|---|---|---|---|---|---|---|---|---|---|---|---|---|
| Comparative example | 9 I | 471° C. | 499° C. | 28° C. | 367 | 0.83 | 0.54 | 1.54 | 234 | 179 | 7.6 | 51 | X |
| | 10 J | 483° C. | 504° C. | 21° C. | 369 | 0.49 | 0.17 | 2.88 | 194 | 138 | 12.3 | 34 | ○ |
| | 11 K | 481° C. | 502° C. | 21° C. | 373 | 0.89 | 0.62 | 1.44 | 237 | 182 | 6.9 | 54 | X |
| | 12 L | 478° C. | 503° C. | 25° C. | 372 | 0.45 | 0.16 | 2.81 | 167 | 109 | 16.2 | 31 | ○ |

*1The cooling rate is an average cooling rate between material temperatures of 450 to 250° C. in the plate thickness central portion From Table 2, it can be confirmed that each of manufacturing Nos. 1 to 8 corresponding to Examples of the present invention obtained tensile strength of 200 MPa or more and yield strength of 140 MPa or more and ultra thick plates that have strengths exceeding largely the strength of JIS 5052 alloy-H112 thick plate material. Further, it was also confirmed that, in these thick plate materials, the difference in strength between the plate thickness surface layer portion and the plate thickness central portion was 50 MPa or less, and that the difference in strength in the plate thickness direction was reduced.

In contrast, alloy thick plates of manufacturing Nos. 9 to 12 being Comparative Examples were decided "failure" in either the strength of the thick plate or the strength difference in the plate thickness direction. That is, the manufacturing Nos. 9 and 11 showed strength difference exceeding 50 MPa between the plate thickness surface layer portion and the plate thickness central portion. These aluminum alloy thick plates were alloys containing Mg exceeding the standard quantity (manufacturing No. 9) or containing Si exceeding the standard quantity (manufacturing No. 11) in the alloy composition. Si and Mg are additive elements that form fine $Mg_2Si$ deposits to contribute to the improvement of the material strength. It is considered that, when these elements become excessive, the strength of a thick plate rises, but the difference in strength between the plate thickness surface layer portion and the plate thickness central portion tends to become large proportionately.

Further, manufacturing Nos. 10 and 12 could not clear standards that tensile strength of the plate thickness central portion was 200 MPa or more and the yield strength was 140 MPa or more. It is considered that the manufacturing No. 10 is an aluminum alloy containing Si of less than the standard quantity and strength rise caused by deposits was small. Moreover, Manufacturing No. 12 is an aluminum alloy containing Mg exceeding the standard quantity, and it is considered that, in the instance of the alloy, the concentration of Si that is bonded with Mg to generate deposits is near the lower limit, and therefore, the strength rise by deposits was small.

Second Embodiment

In the present embodiment, mainly, plural kinds of thick plates composed of the aluminum alloy having the composition of an alloy No. A were manufactured under varied manufacturing conditions, and their strength and observation of material structure were measured. In the present embodiment, while conditions of a solution treatment, a subsequent deposition treatment by cooling and a cooling rate of quenching were adjusted, aluminum alloy thick plates were manufactured. Meanwhile, also in the present embodiment, prior to a solution treatment and a quenching treatment, facing of 10 mm on a side was performed as a surface flattening treatment.

The manufacturing process of an aluminum alloy thick plate in the present embodiment is basically the same as that in the first embodiment, and manufacturing conditions other than the solution treatment (temperature and time), temperature in the deposition treatment and the cooling rate of quenching were set to be the same as those in the first embodiment. Further, the structure observation and the method and condition of strength measurement after manufacturing aluminum alloy thick plates were also set to be the same as those in the first embodiment. The evaluation results are shown in Table 3.

TABLE 3

| Manufacturing No. | Alloy No. | Condition of solution treatment | Ingot temperature before quenching: Surface | Central portion | Central Portion surface | Cooling rate (° C./hr)*1 | Area ratio of $Mg_2Si$ (%): Surface layer portion | Central portion | Surface layer/ Central portion | Tensile properties of plate thickness central portion: TS (Mpa) | YS (Mpa) | EL (%) | Difference in strength (Mpa) | Evaluation of warpage |
|---|---|---|---|---|---|---|---|---|---|---|---|---|---|---|
| Example | 13 A | 530° C. × 11 hr | 478° C. | 503° C. | 25° C. | 370 | 0.69 | 0.31 | 2.23 | 226 | 172 | 8.9 | 35 | ○ |
| | 14 A | 540° C. × 2 hr | 475° C. | 502° C. | 27° C. | 310 | 0.7 | 0.35 | 2.00 | 225 | 162 | 7.9 | 36 | ○ |
| | 15 A | 490° C. × 20 hr | 471° C. | 481° C. | 10° C. | 180 | 0.59 | 0.44 | 1.34 | 209 | 161 | 7.8 | 45 | ○ |
| | 16 A | 520° C. × 17 hr | 452° C. | 482° C. | 30° C. | 230 | 0.79 | 0.33 | 2.39 | 218 | 156 | 7.7 | 29 | ○ |

TABLE 3-continued

| Manufacturing No. | Alloy No. | Condition of solution treatment | Ingot temperature before quenching: Surface | Ingot temperature before quenching: Central portion | Ingot temperature before quenching: Central Portion surface | Cooling rate (° C./hr)*1 | Area ratio of $Mg_2Si$ (%): Surface layer portion | Area ratio of $Mg_2Si$ (%): Central portion | Area ratio of $Mg_2Si$ (%): Surface layer/Central portion | Tensile properties of plate thickness central portion: TS (Mpa) | Tensile properties of plate thickness central portion: YS (Mpa) | Tensile properties of plate thickness central portion: EL (%) | Difference in strength (Mpa) | Evaluation of warpage |
|---|---|---|---|---|---|---|---|---|---|---|---|---|---|---|
| 17 | A | 530° C. × 11 hr | 478° C. | 503° C. | 25° C. | 120 | 0.74 | 0.34 | 2.18 | 204 | 154 | 7.9 | 33 | ○ |
| Comparative example 18 | A | 500° C. × 11 hr | 481° C. | 496° C. | 7° C. | 370 | 0.44 | 0.39 | 1.13 | 222 | 171 | 8.8 | 53 | X |
| 19 | C | 540° C. × 8 hr | 480° C. | 504° C. | 24° C. | 80 | 0.78 | 0.49 | 1.59 | 187 | 121 | 9.5 | 21 | ○ |

*1The cooling rate is an average cooling rate between material temperatures of 450 to 250° C. in the plate thickness central portion From Table 3, it was confirmed that each of manufacturing Nos. 13 to 17 corresponding to Examples was good aluminum alloy thick plates having high strength and a small difference in strength in the plate thickness direction. For these aluminum alloy thick plates, good warpage evaluations were obtained. When concrete examinations are performed, manufacturing Nos. 15 and 16 are Examples lying near the upper and lower limits of conditions of the difference in temperatures at the aluminum alloy surface and the plate thickness central portion (10° C. or more and 30° C. or less) in the deposition treatment prior to quenching. Each of these alloys shows good properties. Further, manufacturing No. 17 is a thick plate manufactured near the lower limit of the condition of a cooling rate (100° C./h or more) in a quenching treatment, and the tensile strength exceeds 200 MPa to give a good result.

In contrast, manufacturing No. 18 is a thick plate treated at a temperature falling below the lower limit (10° C.) of the difference in temperatures between the aluminum alloy surface and the plate thickness central portion in a deposition treatment prior to the quenching. In the aluminum alloy thick plate, as for an area ratio of $Mg_2Si$ having circle equivalent diameters of 3 μm or more, the plate thickness surface layer portion falls below 1.2 times the plate thickness central portion. Consequently, it was confirmed that the difference in strength between the plate thickness surface layer portion and the plate thickness central portion exceeded 50 MPa and the difference in strength in the plate thickness direction became large. Further, in the manufacturing No. 19, it was confirmed that the cooling rate in the quenching treatment was too low and, therefore, the area ratio of coarse deposits in the plate thickness central portion exceeded 0.45%, and that it could not clear the standard of tensile strength of 200 MPa or more and yield strength of 140 MPa or more to show strength poverty.

INDUSTRIAL APPLICABILITY

As described hereinbefore, the present inventive high-strength 6000-based alloy thick plate is a high-strength thick plate material having uniform strength in the plate thickness direction. In the manufacturing method of the high-strength aluminum alloy thick plate, it is possible to manufacture a thick plate of 200 mm or more without considering restriction on facilities for flat correction for reducing internal stress that has been necessary for conventional methods, because the flat correction is not indispensable. The present inventive high-strength 6000-based alloy thick plate may be applied as a constituent material of manufacturing apparatuses of electronic components such as a liquid crystal panel, and machine components of semiconductor manufacturing apparatuses or vacuum chambers, etc., and may also respond to a requirement for increase in size of these apparatuses.

What is claimed is:

1. A high-strength aluminum alloy thick plate composed of an aluminum alloy comprising Si: 0.2 to 1.2 mass % (hereinafter, denoted by %), Mg: 0.2 to 1.5%, Ti: 0.005 to 0.15%, Fe: 1.0% or less, and the balance Al and inevitable impurities, wherein the high-strength aluminum alloy thick plate has a material structure in which:

an area ratio of Mg2Si having circle equivalent diameters of 3 μm or more in a plate thickness central portion is 0.45% or less; and an area ratio of Mg2Si having circle equivalent diameters of 3 μm or more in a region of 20 mm±1.5 mm from a plate surface in a plate thickness direction is 1.2 times or more and 3.0 times or less the area ratio of Mg2Si having circle equivalent diameters of 3 μm or more in the plate thickness central portion.

2. The high-strength aluminum alloy thick plate according to claim 1, further comprising any one or more of Cu: 0.05 to 1.2%, Zn: 0.05 to 0.5%, Mn: 0.05 to 1.0%, Cr: 0.05 to 0.5%, and Zr: 0.05 to 0.2%.

3. A method for manufacturing a high-strength aluminum alloy thick plate, the high-strength aluminum alloy thick plate being defined in claim 1, comprising the steps of:

performing a solution treatment of heating an aluminum alloy at a temperature of 480° C. or higher for 1 hour or longer;

then cooling the aluminum alloy so that a temperature of a plate thickness central portion of the aluminum alloy is 480° C. or higher and a temperature of a surface of the aluminum alloy is higher than the temperature of the plate thickness central portion by 10° C. or more and 30° C. or less;

subsequently performing a quenching treatment of rapidly cooling the aluminum alloy so that a cooling rate of the plate thickness central portion of the aluminum alloy becomes 100° C./hr or larger; and furthermore, performing an artificial aging treatment.

4. A method for manufacturing a high-strength aluminum alloy thick plate, the high-strength aluminum alloy thick plate being defined in claim 2, comprising the steps of:

performing a solution treatment of heating an aluminum alloy at a temperature of 480° C. or higher for 1 hour or longer;

then cooling the aluminum alloy so that a temperature of a plate thickness central portion of the aluminum alloy is 480° C. or higher and a temperature of a surface of the aluminum alloy is higher than the temperature of the plate thickness central portion by 10° C. or more and 30° C. or less;

subsequently performing a quenching treatment of rapidly cooling the aluminum alloy so that a cooling rate of the plate thickness central portion of the aluminum alloy becomes 100° C./hr or larger; and furthermore, performing an artificial aging treatment.

* * * * *